United States Patent [19]

Alexander et al.

[11] Patent Number: 4,656,681

[45] Date of Patent: Apr. 14, 1987

[54] WATER MATTRESS

[75] Inventors: Bruce H. Alexander, Catonsville; Iftakhar Malik, Laurel, both of Md.

[73] Assignee: United States Water Mattress Co, Baltimore, Md.

[21] Appl. No.: 853,443

[22] Filed: Apr. 18, 1986

[51] Int. Cl.[4] ..... A47C 27/08

[52] U.S. Cl. ..... 5/451; 5/441; 5/449

[58] Field of Search ..... 5/451, 450, 452, 449, 5/441, 455, 500, 502, 484, 473

[56] References Cited

U.S. PATENT DOCUMENTS

| | | | |
|---|---|---|---|
| 3,251,075 | 5/1966 | Saltness et al. | 5/441 |
| 3,283,343 | 11/1966 | Worcester | 5/441 |
| 3,421,163 | 1/1969 | Stoughton | 5/449 |
| 4,317,244 | 3/1982 | Balfour-Ritchie | 5/449 |
| 4,338,693 | 7/1982 | Vitale | 5/500 |
| 4,577,357 | 3/1986 | Hall et al. | 5/451 |

*Primary Examiner*—Alexander Grosz

*Attorney, Agent, or Firm*—John C. LaPrade

[57] ABSTRACT

An improved water mattress having a multi-layer top panel, the multi-layers consisting of at least two sheets of vinyl which are plastic heat sealed in a manner to provide small pillow shaped pockets, each such pillow having an internal layer of polyester or equivalent fiber material or a woven fabric material. The improved multi-layer top panel has utility in improving the hand or feel of the top panel as well as improving the appearance and useability of the water mattress. The multi-layer top panel also functions to improve the insulation of the mattress.

8 Claims, 4 Drawing Figures

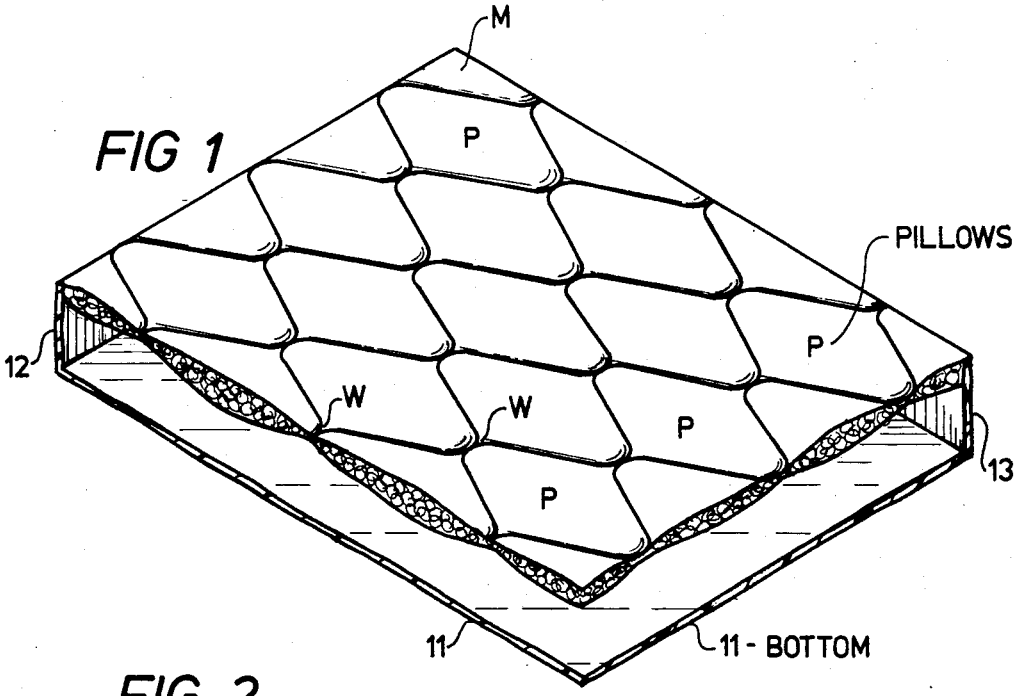
FIG 1
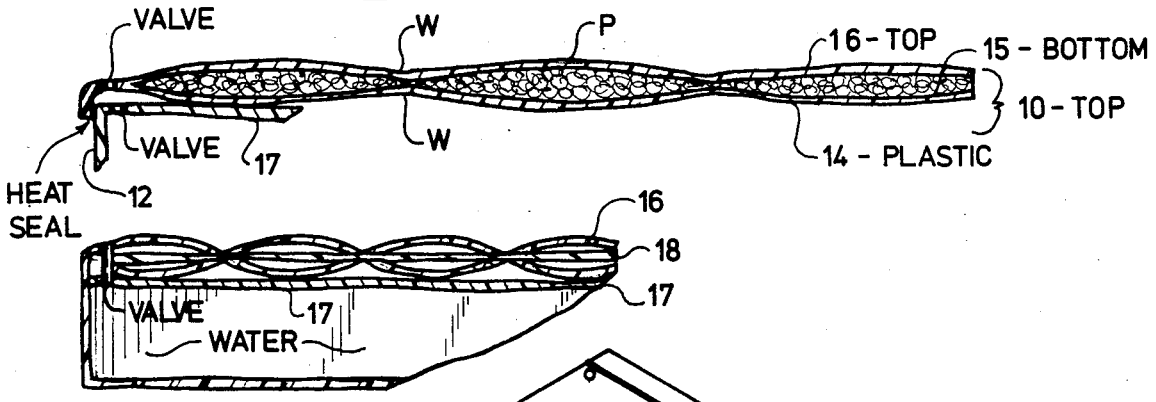
FIG 2
FIG 3
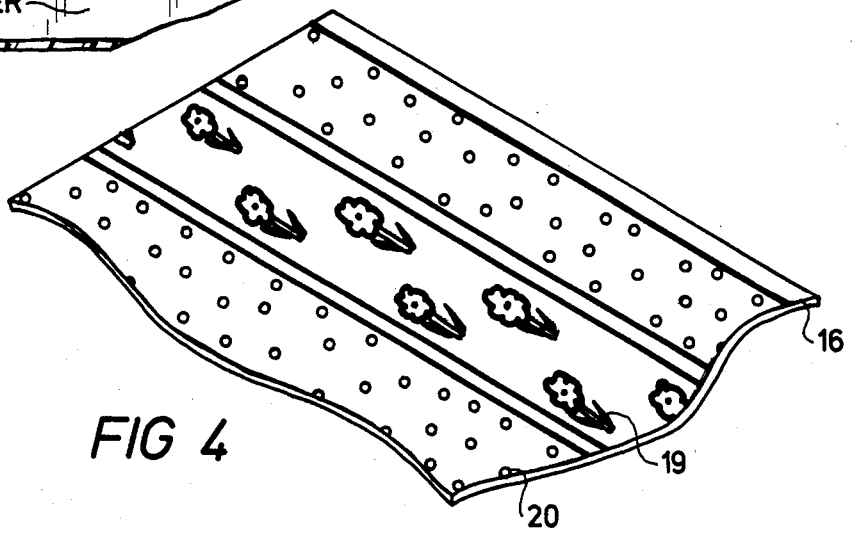
FIG 4

WATER MATTRESS

This invention comprises an improved water mattress having a multi-layer top panel. The top sheet of the panel is heat sealed to the lower layers in a way that forms small pillows that contain fabric fiber batting.

OBJECTS OF THE INVENTION

It is one object of this invention to provide an improved water mattress having use in a water bed, having a top panel, usually made of vinyl or plastic material that is capable of being heat sealed, having multiple layers of vinyl with at least one intermittent layer of polyester batting or alternatively polyester or other soft fabric that is heat sealed between top and bottom sheets of vinyl.

It is one further object of the invention to provide a new and improved water mattress having a novel top panel, consisting of several layers of vinyl and polyester heat sealed together to form small quilted pillows, to give an improved appearance as well as a combined improved, hand or feel to touch to the user so that no mattress pad or covering is necessary.

SUMMARY OF INVENTION

This invention relates to water bed mattresses and top panels that are a part of the structure of the water mattress.

The water mattress of the described invention may contain a wave motion damper or wave motion absorber of the type shown in the Phillips U.S. Pat. No. 4,475,257 or Carpenter U.S. Pat. No. 4,325,152 or a floatation mattress with a wave inhibiting chamber within a liquid envelope having two opposed interior surfaces of the type shown in U.S. Pat. No. 4,325,152 issued to Michael Carpenter.

The instant invention comprises a top panel made of at least two sheets of material, each of said sheets being a polyvinyl or polyethylene material that is capable of being heat sealed, one sheet to the other. Between these two sheets is placed and positioned a polyester or random fiber polyester material usually in the form of batting or woven polyester fabric. The top vinyl sheet is then heat sealed to the bottom vinyl sheet to form a plurality of small pillow like shapes, each pillow having the feel and hand characteristic of the polyester and the appearance of a quilted or tufted material utilized in conventional bedding.

It is an object of the invention to provide a multilayer top sheet that is attached by heat sealing to the side walls defined by end panels and side panels, a top panel having at least an upper and lower vinyl sheet heat sealed to a middle layer of material that may comprise polyester cotton, silk or another woven or nonwoven fiber that is particularly soft and pliable and creates good hand as well as providing a decorative color scheme either within the middle section or on the top sheets so as to allow the top sheet to have an unusual and decorative appearance.

BRIEF DESCRIPTION OF DRAWINGS

FIG. 1 is a perspective view of the top panel of a water mattress embodying the pillow effect of the multi-layer top sheet of the invention.

FIG. 2 is a cross section of a water mattress showing a multi-layer top panel of the instant invention in place and sealed to the side panels that are heat sealed to the bottom panel of the envelope.

FIG. 3 is a cross section of an alternative embodiment showing a multi-layer top panel containing a woven fiber material as the center portion of the top panel.

FIG. 4 is a perspective view of a top panel having a floral pattern that is in this embodiment printed or embossed on the top vinyl sheet that is internally heat sealed to a polyester batting, and is heat sealed through polyester batting to a bottom vinyl sheet that makes up a composite top panel that is in turn sealed around its periphery to the end and side panels of the conventional water mattress.

PREFERRED EMBODIMENT

Referring now to the drawings, the invention involves a basic flotation mattress structure M comprised of an envelope of thin flexible and supple plastic sheet material such as polyvinyl chloride. The mattress M is rectangular in plan configuration as characterized by flat horizontal and vertically spaced top and bottom panels 10 and 11. The side panel 12 is shown in FIG. 1, and the end panel is illustrated as 13 in FIG. 1.

In one embodiment best shown in FIG. 2, the top panel 10 is made up of a bottom sheet of plastic or vinyl material 14 and intermediate layer of polyester batting 15 and a top vinyl or plastic sheet 16. The three layers of material shown in FIG. 2 are heat sealed together by radio wave or radio sonic heat sealing equipment to form a weld at point W as shown in FIG. 2.

In an alternative embodiment, best shown in FIG. 3, a safety sheet 17 may be welded or heat sealed around the entire periphery of the envelope so as to be heat sealed to both the end panels 13 and the side panel 12 at a point just below top panel 10. Sheet 18, in this embodiment, may comprise a woven fabric material usually made of polyester, cotton, silk, rayon, velvet, or other well known woven fabric. This fabric material will usually be soft, pliable and improve the overall hand of the top panel of the water mattress.

FIGS. 2 and 3 illustrate a conventional valve for a watermattress. Any valve that allows water to be added or removed will work and must have a conventional plug, cover or screwfitted cover to close the opening shown in FIGS. 2 and 3. The valve may be located on the top wall.

In FIG. 4 the top sheet 16 is shown having floral pattern 19. In addition, the polka dot pattern 20 may border the floral pattern 19. A top sheet 16, formerly the top layer of the water mattress as shown in FIGS. 2 and 3, when the top sheet 16 overlays and is heat sealed to polyester batting 15 or a woven fabric 18 will give an improved water mattress having both excellent soft hand or feel to the user as well as decorative top sheet so that no additional bed cover or mattress cover need to be used, as is now common in the industry.

The mattress shown in FIG. 1, in a cutaway view may be made in any desirable size, i.e., king size, queen size, or single bed.

The example of how to manufacture a queen size water bed mattress is set forth in detail hereinafter in this application.

The bottom sheet usually made of polyvinyl chloride or other thermal vinyl sheet material such as polyethylene may be a sheet material varying in thickness from 12 to 20 mils usually polyvinyl chloride. The bottom sheet is first laid out and then covered with a thin piece of batting usually a polyester or cotton or other fiber batting well known in the textile industry. This batting or equivalent fabric may be from one eighth to one half inch in thickness and is physically laid over the bottom sheet 14 as illustrated in FIG. 2. On top of the batting 15 or sheet fabric material 18 another sheet of plastic material such as polyvinyl chloride is laid. This top sheet 16 shown in FIGS. 2 and 3 may be made of a solid color vinyl material or it may be printed with various solid colors or pastel floral prints. The two sheets of vinyl or plastic material 14 and 16 with the intermediate batting layer 15 or the fabric layer 18 are then subjected to a patterned heat sealing to form small pillows P best shown in FIG. 1. The pillows P are formed by the heat welds W around the periphery of each pillow.

Conventional heat sealing equipment, well known in the industry such as sonic or radio frequency heat sealing equipment now used in the waterbed industry can be used to form each heat weld W around the outer edge of each pillow P.

In one embodiment, the top sheet 16 may be made of a clear vinyl or clear thermoplastic material such as polyethylene that overlays a colored batting, i.e, blue polyester fibers, in a thickness approximately one quarter inch in thickness. In such case when the clear sheet 16 is sealed around the weld area w shown in FIG. 1, the top sheet with the pillows P formed by the heat sealed weld lines will have a blue appearance that will be very decorative and will add to the saleability of the water mattress.

In the embodiment shown in FIG. 3 the safety sheet 17 may be of a generally thinner material varying between 10 and 15 mils in thickness. This safety sheet is usually made of polyvinyl chloride or other thermo plastic material.

EXAMPLE

The method of making a polyester quilt waterbed mattress is as follows:

The design and fabrication of a top panel of a water mattress begins with a 20 mil, polyvinyl chloride sheet (bottom) cut to the size of the surface of the mattress, i.e., a queen size. To this bottom sheet, layer a thin piece of batting, polyester or other fabric approximately ¼" thick is added. Greater thickness may be added if a greater quilt effect is desired. This batting should be cut to the size of the surface being made, i.e., queen size. On top of this batting, place a 20 mil sheet of PVC in the color desired for the consumer to see (printed with varying colors, solid color, etc.). Heat seal all three layers together sonically or via radio frequency "heat seal." The resulting top panel should appear like a quilt similar to blankets, some mattresses, windbreaker vests, etc. depending on the pattern employed in the quilter.

Under this top panel, it may be advisable to place an additional sheet of 10 or 12 mil vinyl under the quilted area, again heat-sealing, with a radio frequency heat sealing, as a safety sheet in case the quilted sections should flex and leak. The surface will then have three layers of vinyl with one sheet of batting material between the top surface PVC sheets, and the bottom PVC sheet. Other thermoplastic materials may be substituted for polyvinyl chloride.

BENEFITS TO THE USER

The texture of this water mattress will feel softer and "cushioned" due to the air and polyester combination together between vinyl or plastic sheets 16 and 14.

We claim:

1. A floatation mattress comprised of an envelope with a top body supporting panel and where the top panel is heat sealed to side and end panels and each of the side and end panels is heat sealed to a bottom panel, and wherein the top panel consists of multiple sheets of vinyl and a fiberous material that are heat sealed together to form a multi-layer top panel.

2. The mattress of claim 1 wherein the top panel consists of three distinct layers of material, the bottom layer being a plastic sheet, overlayed with a fiberous layer and a top sheet of a plastic sheet, where the layers being heat sealed in a formal pattern to form a plurality of small pillows on the top panel.

3. The mattress of claim 2 wherein polyester fiber batts are heat sealed between the top and bottom sheets of plastic.

4. The mattress of claim 3 wherein the top plastic sheet comprises polyvinyl chloride material having a thickness from 10 to 30 mils.

5. The mattress of claim 4 wherein the bottom plastic sheet comprises a polyvinyl chloride material have a thickness from 10 to 30 mils.

6. The mattress of claim 5 wherein the fibers are polyester batts having an average thickness of from 20 to 50 mils.

7. The mattress of claim 6 wherein a safety sheet is heat sealed to the side panels and end panels below the top panel.

8. The mattress of claim 2 wherein the top panel is heat sealed to a conventional, prefinished mattress before it is valved, by heat sealing the top panel to the prefinished mattress all the way around the perimeter of the top panel.

* * * * *